United States Patent [19]

Davies

[11] 3,991,662

[45] Nov. 16, 1976

[54] PACKING MACHINES

[75] Inventor: Robert William Davies, London, England

[73] Assignee: Molins Limited, London, England

[22] Filed: July 18, 1975

[21] Appl. No.: 597,272

Related U.S. Application Data

[62] Division of Ser. No. 367,054, June 4, 1973, Pat. No. 3,911,643.

[30] Foreign Application Priority Data

June 8, 1972 United Kingdom ..... 26900/72

[52] U.S. Cl. ..... 93/12 C; 83/107; 53/389; 93/44; 93/40

[51] Int. Cl.[2] ..... B31B 1/30; B31B 15/26

[58] Field of Search ..... 93/12 C, 44, 44.1 R, 93/40, 43, 45, 40.1; 53/168, 202, 389; 83/102, 107

[56] References Cited

UNITED STATES PATENTS

| | | | |
|---|---|---|---|
| 2,499,570 | 3/1950 | Crafts | 83/107 |
| 2,691,257 | 10/1954 | Vogt | 53/202 X |
| 2,810,998 | 10/1957 | Niepmann | 53/183 |
| 3,507,095 | 4/1970 | Kuhnle | 93/44.1 R X |
| 3,579,952 | 5/1971 | Davies et al. | 53/183 X |
| 3,871,270 | 3/1975 | Kuckhermann et al. | 93/8 R X |

*Primary Examiner*—James F. Coan
*Attorney, Agent, or Firm*—John C. Smith, Jr.

[57] ABSTRACT

A machine for packing cigarettes in which packets, having one open end, are made by successively wrapping an inner layer of foil and an outer layer of paper round a former, transferring the open ended packets into a pocket on a conveyor, and then inserting a batch of twenty cigarettes into each packet. A plurality of packet-making devices, and batch-forming devices are provided, the conveyor being so positioned that each pocket first passes all the packet-making devices in succession and then all the batch-forming devices in succession.

15 Claims, 14 Drawing Figures

FIG. 3.
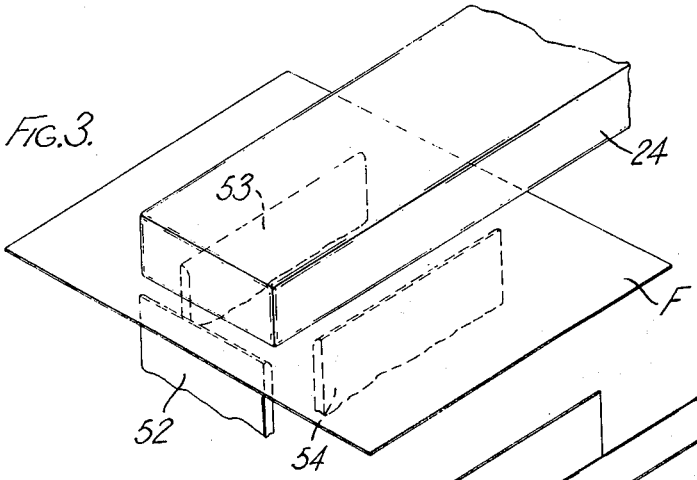
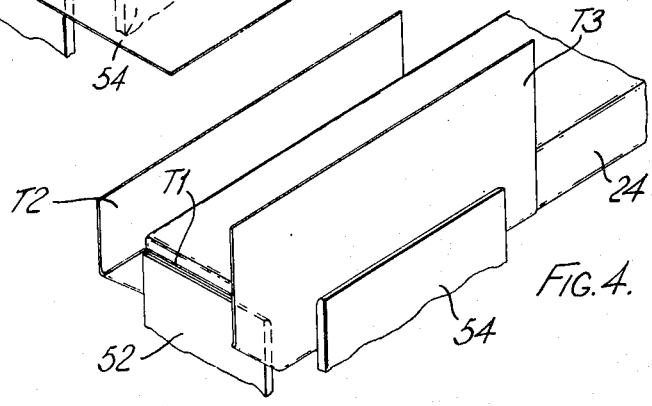
FIG. 4.
FIG. 5.
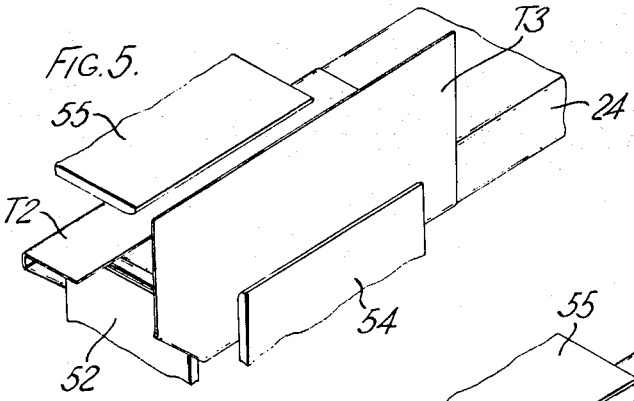
FIG. 6.
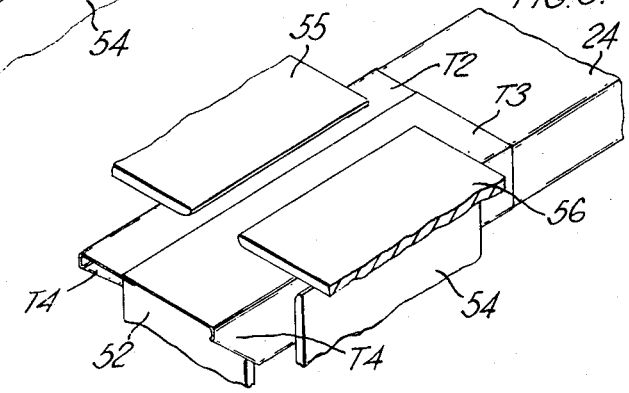

FIG. 11.
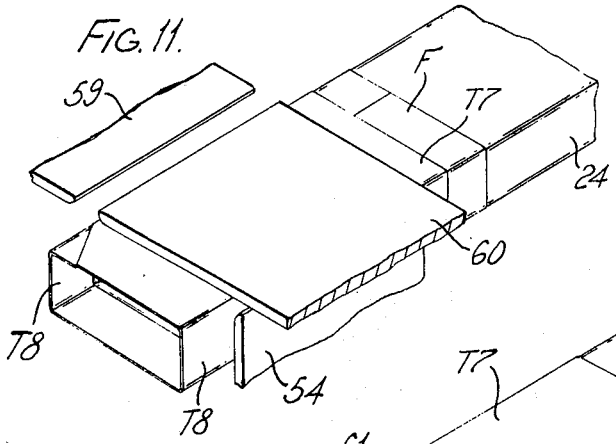
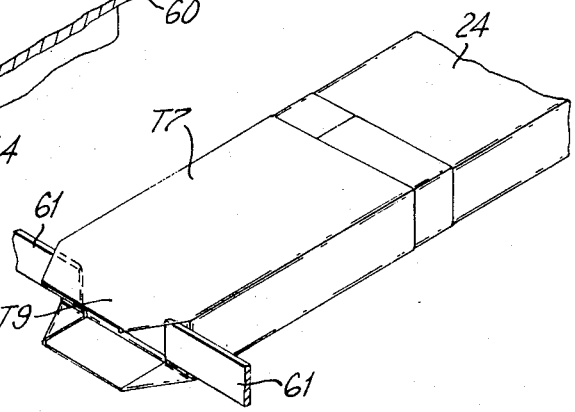
FIG. 12.
FIG. 13.
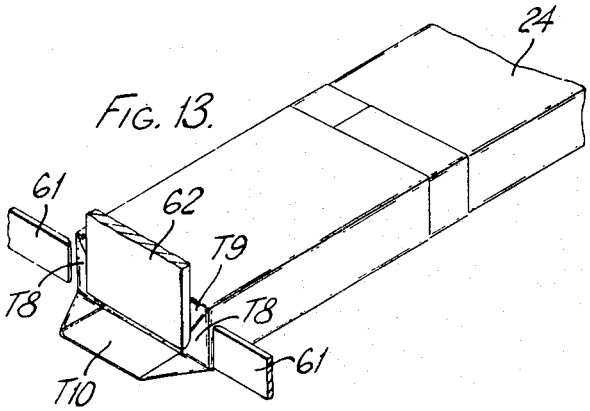
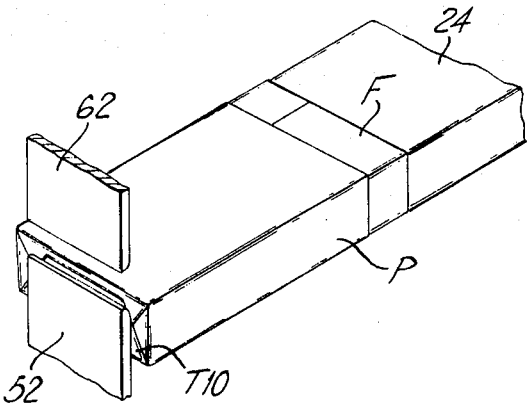
FIG. 14.

PACKING MACHINES

This is a division of application Ser. No. 367,054 filed June 4, 1973 (now U.S. Pat. No. 3,911,643 issued Oct. 14, 1975).

This invention is concerned with apparatus for making packets, especially for rod-like articles such as cigarettes.

The present invention is particularly, though not exclusively, useful in machines for producing the well known "soft pack", that is, a cigarette packet which is made of paper material rather than card.

According to one aspect of the invention there is provided apparatus for making packets comprising a plurality of devices each adapted to receive packet blanks in succession and subject each blank in turn to a sequence of folding and sealing operations, in which blank feeding means are provided to feed blanks from a common source to all the said devices, said blank feeding means including conveying means defining paths from said common source to said devices and being adapted to cause blanks to be conveyed along each of said paths in rotation.

The apparatus for making packets may be embodied in a packing machine for cigarettes or other articles such as that described and claimed in U.S. application Ser. No. 367,054.

A preferred embodiment of the invention will now be described, by way of example only, with reference to the accompanying drawings, in which:

FIGS. 3 to 8 show perspective views of successive stages in folding a piece of foil round a former, and FIGS. 9 to 14 show perspective views of successive stages in folding a label round the same piece of foil and former as in FIGS. 3 to 8.

Figure 1:
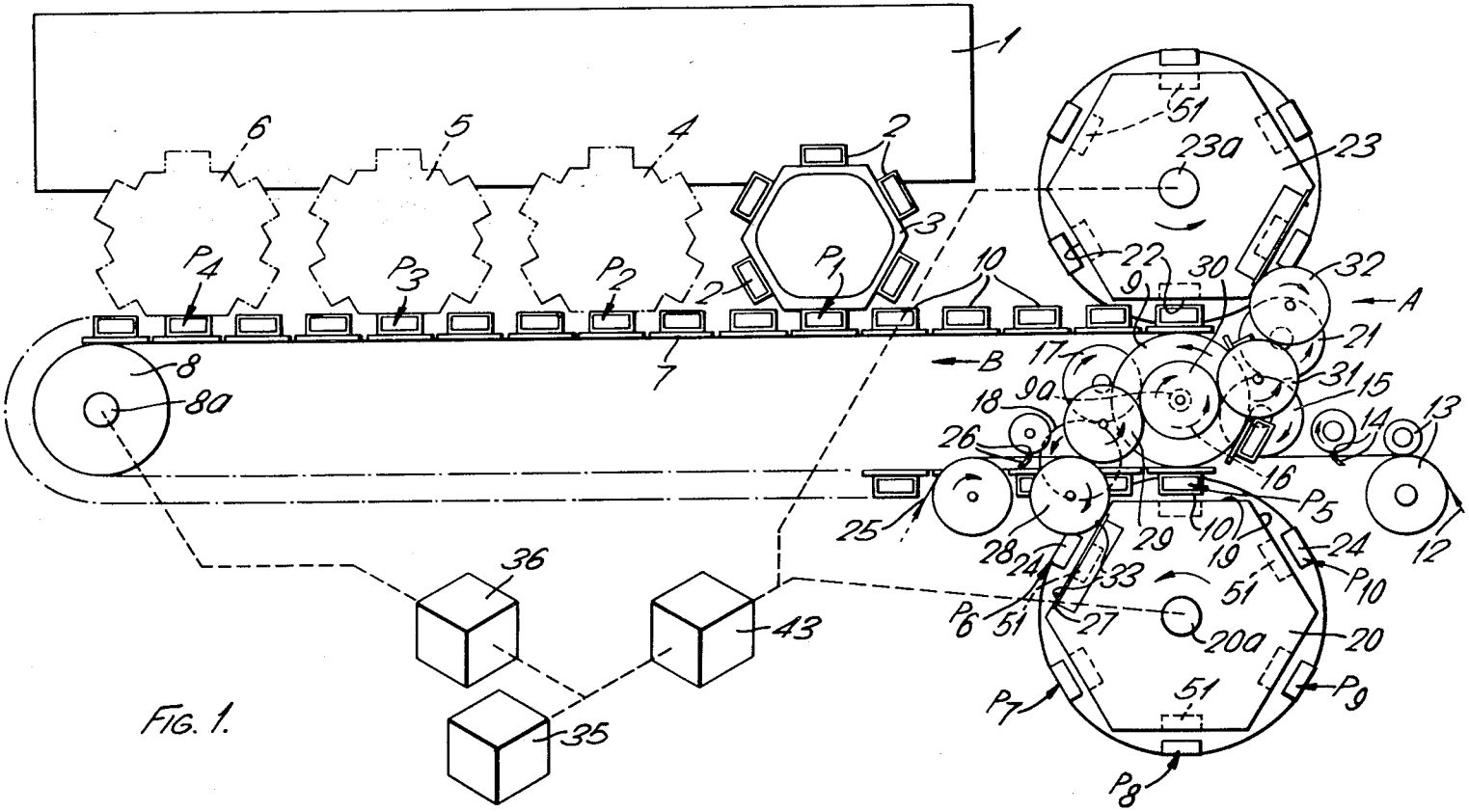
FIG. 1 is a diagrammatic front view of a cigarette packing machine.

The machine comprises a cigarette hopper 1, of any convenient construction, from which batches of 20 cigarettes are removed and fed into hollow compartments 2 mounted on an intermittently rotatable turret 3, a batch of cigarettes being fed into a compartment each time the turret 3 comes to rest. In FIG. 1 three further turrets 4, 5 and 6, shown in chain dot lines, are shown, each of which is identical to turret 3 and are rotated in synchronism with it, so that each time the turrets 3 to 6 come to rest four batches of cigarettes are removed from the hopper 1.

With this arrangement, each time the turrets 3 to 6 come to rest, a compartment 2 containing a batch of cigarettes is positioned at each of the positions marked P1, P2, P3 and P4 in FIG. 1. It should be noted that the cigarettes are moved lengthwise into the compartments 2 from the hopper 1.

Figure 2:
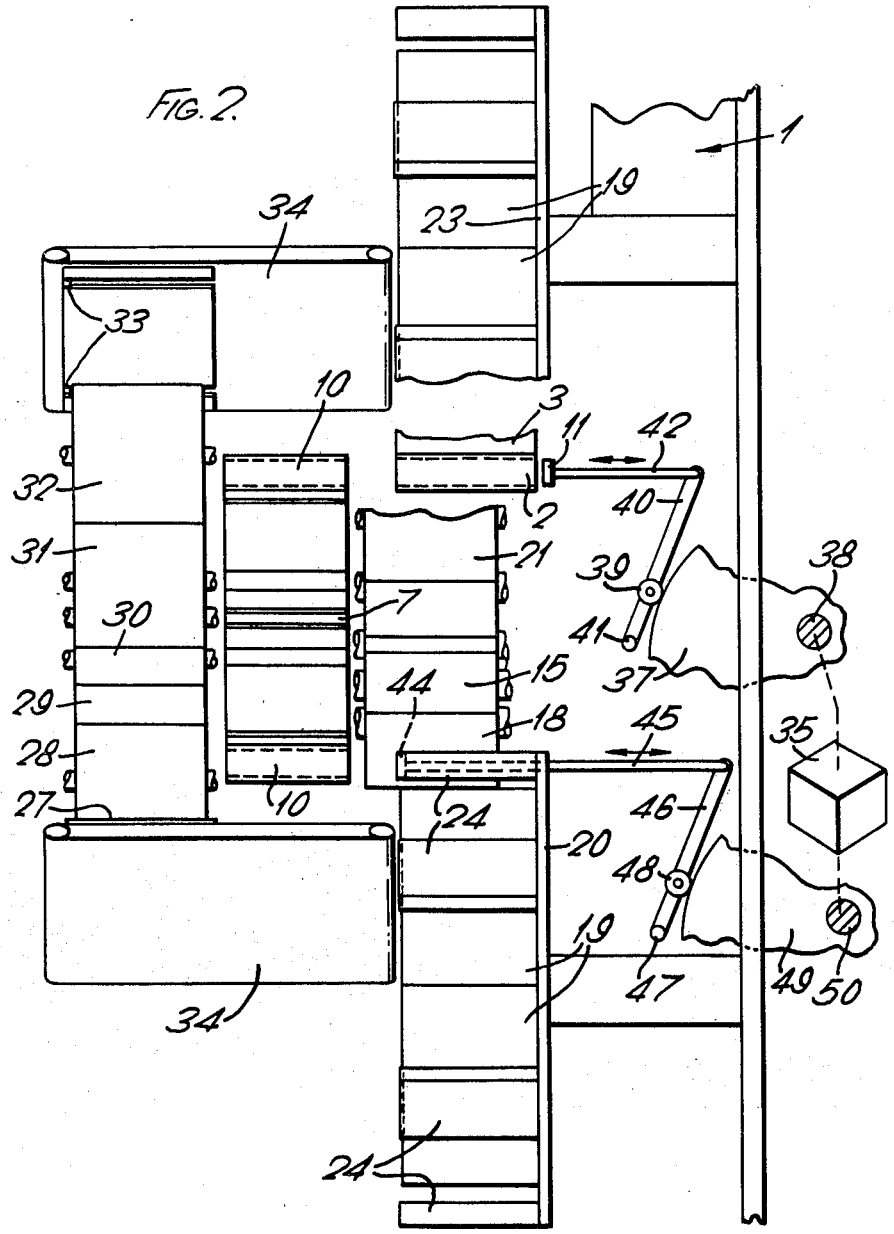
FIG. 2 is a diagrammatic view taken in the direction of arrow A of FIG. 1, and drawn to a larger scale.

Positioned adjacent the left hand end of the turrets 3 to 6, as viewed in FIG. 2, is an endless conveyor 7 carried by two pulleys 8, 9, fixed to shafts 8*A*, 9*a* respectively, and driven intermittently, in the direction of arrow B, FIG. 1, in synchronism with the turrets 3 to 6. The shaft 8*a*, and thus also the conveyor 7, is driven by a motor, diagrammatically shown in FIG. 1 at 35, via a gear box of any convenient known type having a continuously rotatable input shaft and an intermittently rotatable output shaft; such a gear box being shown diagrammatically in FIG. 1 at 36. The arrangement is such that the output shaft of the gear box 36 is connected to the shaft 8*a*.

Mounted on the conveyor 7 are a plurality of hollow pockets 10, each of which is to have an open ended packet inserted therein, as will be described later. A pusher 11 is mounted opposite the right hand end, as viewed in FIG. 2, of each of the turrets 3 to 6 in line with each of the compartments at positions P1 to P4.

The turrets 3 to 6 and conveyor 7 are so arranged and constructed that each time the turrets and the conveyor come to rest, one of the pockets 10 is aligned with one of the compartments 2 at positions P1, P2, P3, P4. The pitch of the pockets 10 on the conveyor 7 and the distance between successive positions P1 to P4 are such that every third pocket 10 is aligned with a compartment 2 each time the turrets 3 to 6 and conveyor 7 come to rest as mentioned above.

The conveyor 7 is driven so that on each intermittent movement the pockets 10 move two pitches and the drive to the turrets is adapted to rotate the turrets one compartment pitch for every two intermittent movements of the conveyor 7. With this arrangement successive batches of cigarettes arriving at each of the positions P1 to P4 are pushed lengthwise by a pusher 11 from a compartment 2 into every fourth pocket 10 on the conveyor 7, so that each pocket 10 beyond position P4, considered in the direction of movement of the conveyor 7 past positions P1 to P4, contains an open ended packet which in turn contains a batch of cigarettes.

Each pusher 11 is operated to remove a batch of cigarettes from one of the compartments 2 at positions P1 to P4 by a cam 37 fixed to a shaft 38 which is driven continuously from the motor 35, FIG. 2. The cam 37 engages a follower 39 carried on a lever 40, one end of which is pivotally connected at 41 to a fixed part of the machine, and the other end of which is connected to an arm 42 which carries the pusher 11. Alternatively the arms 42 may be linked together and a single cam 37, follower 39 and lever 40 provided to operate all the pushers 11.

In some circumstances it may be convenient to have two turrets, e.g. turrets 3, 4 only, from which batches of cigarettes are removed and fed into a pocket 10 on the conveyor 7. However, with this arrangement, the drive to the turrets 3, 4 is adapted to rotate the turrets one compartment pitch for each intermittent movement of the conveyor 7. Thus a batch of cigarettes from each of the turrets 3, 4 is fed into every second pocket 10 on the conveyor 7 and each pocket 10 beyond the position P2, considered in the direction of movement of the conveyor 7 contains an open ended packet which in turn contains a batch of cigarettes.

The making of the open ended packets will now be described.

A continuous web 12 of metal foil is fed from a reel (not shown) by a pair of rollers 13 and cut into pieces of a predetermined length by knives 14, each cut piece of foil being picked up by a suction drum 15. From the drum 15 alternate pieces of foil are fed by suction drums 16, 17, 18 on to one of six platforms 19 carried on an intermittently rotatable wheel 20. Each platform 19 is provided with a table 51 which is movable radially of the wheel 20. The intermediate pieces of foil are fed from drum 15 by suction drum 21 on to one of six platforms 22 carried on a further intermittently rotatable wheel 23. The wheels 20, 23 are fixed to shafts 20a, 23a respectively, which are both driven intermittently from the motor 35 via a gear box similar to the gear box 36 and shown diagrammatically in FIG. 1 at 43. The construction and operation of both the wheels 20, 23 are substantially the same so only wheel 20 will be described.

The wheel 20 also carries six packet formers 24 each of which is spaced a short distance from a platform 19. Each former 24 is provided with a pusher 44 slidably mounted therein, as shown in FIG. 2, and carried on one end of an arm 45. The other end of each arm is connected to a lever 46 which is pivotally connected at 47 to a fixed part of the machine. A cam follower 48 mounted on the lever 46 engages a cam 49 fixed to a shaft 50 which is driven continuously by the motor 35. The wheel 20 is so positioned that each time the wheel comes to rest the next successive former 24 is brought to a position P5 in alignment with one of the pockets 10 on the conveyor 7. Whilst the wheel 20 is stationary a piece of foil (which forms an inner layer of packet material) is fed onto the platform 19 associated with the former 24 which is at position P5. The wheel 20 is then rotated through six intermittent movements, which brings the former 24 previously mentioned back into alignment with a pocket 10 on the conveyor 7. The piece of foil is wrapped round the former 24 as will now be described with reference to FIGS. 3 to 8. The steps involved in wrapping the foil round the former are substantially the same as those described in U.S. Pat. No. 3,579,952 issued May 25, 1971 with reference to FIGS. 18 to 23.

FIG. 3 shows the relative positions of the former 24 which is at position P5, and a piece of foil F which has just been fed on to the associated platform 19. Whilst the wheel 20 is stationary the table 51 is moved radially outwards of the wheel until the foil F engages the former 24. Tuckers 52, 53, 54 are then operated to fold flaps T1, T2, T3 respectively so that the foil is folded as shown in FIG. 4. Flap T2 (FIG. 5) is folded over by tucker 55 and suction is applied through apertures (not shown) in the former 24 to hold the edge of flap T2 against the former, and then tucker 56 folds flap T3 on top of flap T2, the flap T3 also being held against the former 24 by suction, so that the foil is now folded as shown in FIG. 6.

Figure 7:
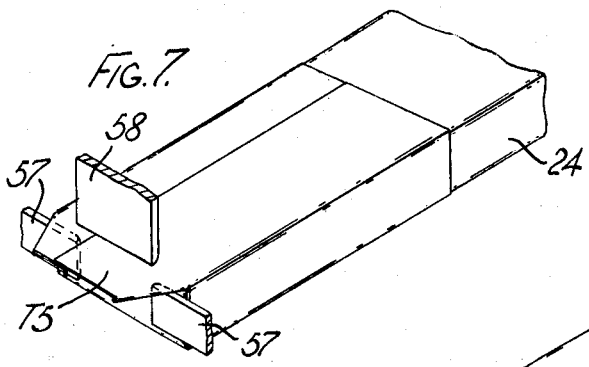
Figure 8:
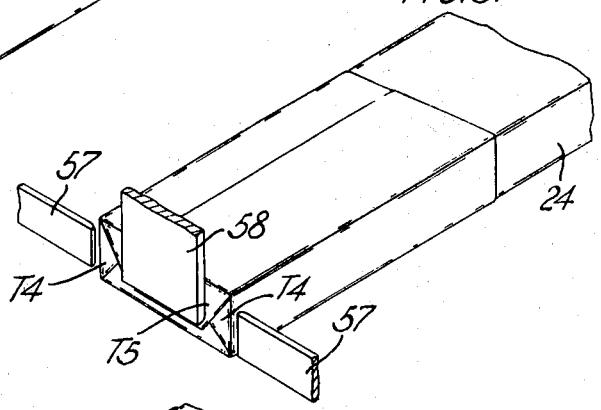

The wheel 20 is now rotated anti-clockwise, as viewed in FIG. 1, through 60° so that the former 24 which was at position P5 is moved to position P6. After the wheel comes to rest the flaps T4 are folded, by tuckers 57, on top of flap T1, as shown in FIG. 7, and the folding of the foil round the former 24 is completed by the flap T5 being folded by tucker 58, as shown in FIG. 8. Whilst the wheel 20 is moving the tuckers 52, 53, 54 are moved away from the positions shown in FIG. 4 to 6, and the table 51 is returned to its starting position.

When the wheel 20 comes to rest after its first intermittent movement from position P5 an outer label (which forms an outer layer of packet material) is fed on to the platform 19. A continuous web 25 is fed from a reel (not shown) and cut into separate labels by knives 26. Alternate labels are fed on to a dead plate 27 associated with wheel 20 by a suction drum 28. The intermediate labels are fed by a series of suction drums 29 to 32 on to a dead plate associated with wheel 23.

The label is moved from the dead plate 27 on to the platform 19 by a pair of lugs 33 carried on a conveyor 34, and during this movement adhesive is applied to the label, by any convenient form of apparatus (not shown), along the edge of flap T3 (FIG. 4) which is later folded to overlap the flap T2, as will be described.

The label is wrapped round the former on top of the foil as will now be described with reference to FIGS. 9 to 14. The steps involved in wrapping the lable round the former are substantially the same as those described in U.S. Pat. No. 3,579,952 issued May 25th 1971 with reference to FIGS. 24 to 29.

Figure 9:
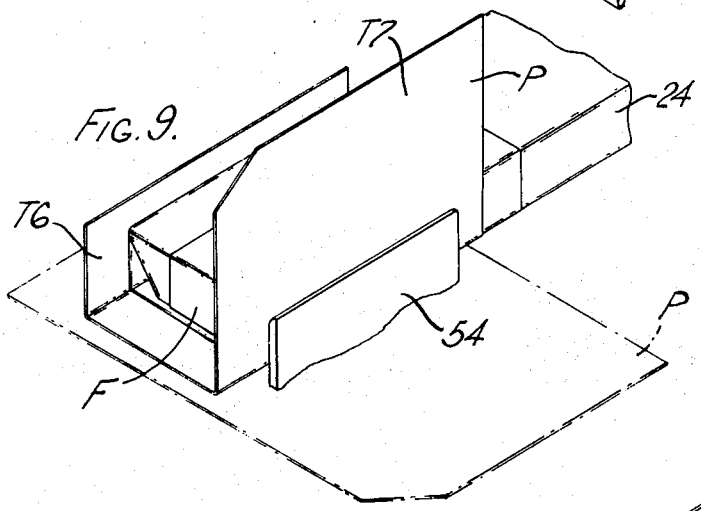
Figure 10:
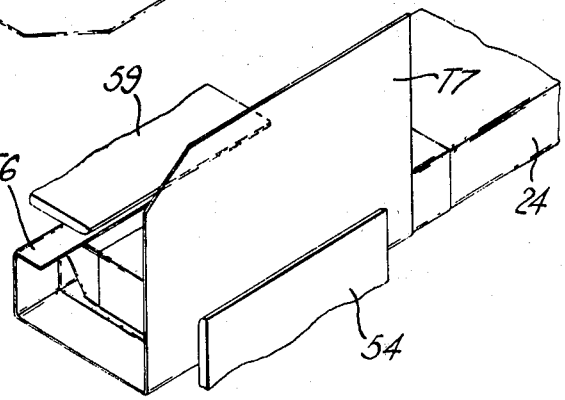

FIG. 9 shows the relative positions of the former 24, which is now at position P6, with the piece of foil F wrapped round it, and a label P, shown in chain-dot lines, which has just been fed to the associated platform 19. Whilst the wheel 20 is stationary the table 51 is again moved radially outwards of the wheel until the label P engages the foil F already wrapped round the former 24. Tuckers 53, 54 are again operated, but this time to fold flaps T6, T7 respectively so that the label P is folded as shown in full lines in FIG. 9.

The wheel 20 is now rotated a further 60° in an anti-clockwise direction, as viewed in FIG. 1 so that the former 24 being considered is moved to position P7. After the wheel comes to rest flap T6 is folded over by tucker 59 (FIG. 10) and flap T7 is folded over by tucker 60 so that it overlaps and sticks to flap T6. At this stage the label P is folded as shown in FIG. 11. The flaps T8 are then folded, by tuckers 61, as shown in FIG. 12, so that they lie on top of the flap T5 of the foil F.

The wheel 20 is now rotated a further 60° in an anti-clockwise direction, as viewed in FIG. 1, so that the former 24 being considered is moved to position P8. After the wheel comes to rest flap T9 is folded over by tucker 62, as shown in FIG. 13, adhesive is applied to the flap T10 by any convenient form of apparatus (not shown) and the folding of the label P round the former 24 on top of the foil F is completed by the flap T10 being folded over and stuck to flap T9 by a further operation of the tucker 52, as shown in FIG. 14. After three further 60° stepwise movements of the wheel 20 the former 24 being considered is carried past positions P9, P10 and brought to rest at position P5. Whilst the former is moving from position P10 to position P5 the tuckers 52, 53, 54 are again returned to their starting positions so that a new piece of foil may be fed to the platform 19.

After the wrapping of the label has been completed as described above and the former 24 on which it is carried is again in alignment with a pocket 10 on the conveyor 7 the pusher 44 mounted inside the former 24 is operated to push the now partly formed packet, one end of which is open, off the former and into the aligned pocket 10. At the same time a similar partly formed packet has been formed on wheel 23 and pushed into a pocket 10. The pitch of the formers on the wheels 20, 23 is such that successive formers 24 of each wheel align with every second pocket of the conveyor 7, and the wheels 20, 23 are so spaced along the conveyor 7 that packets from the wheel 23 are pushed into intermediate pockets to those from the wheel 20, so that all pockets 10 downstream of the drum 23 contain a partly finished packet.

The packets are then fed past the turrets 3 to 6, as previously described, and when they reach a position downstream of the turret 6 the open end of the packet is closed and a stamp serving to hold that end of the packet closed is applied by any convenient known form of apparatus.

I claim:

1. Apparatus for making packets comprising a plurality of packet-making devices, each device comprising means for receiving packet blanks in succession and means for subjecting each blank in turn to a sequence of folding and sealing operations to form an open-ended packet; blank feeding means for feeding blanks along separate paths from a common source to all said packet-making devices, said blank feeding means being adapted to cause blanks to be conveyed along each of said paths in rotation; a plurality of packet-transferring devices, one associated with each packet making device; and conveyor means for receiving said open-ended packets from each of said packet-transferring devices, said packet-transferring devices being arranged in succession in spaced positions along part of said conveyor means so that said conveyor passes each of said packet-transferring devices in turn.

2. Apparatus as claimed in claim 1 wherein said conveyor means comprises an endless conveyor having regularly-spaced carrier members thereon, each packet-transferring device being operable to transfer said open-ended packets from the associated packet-making device into said carrier members on said conveyor.

3. Apparatus as claimed in claim 2 wherein said conveyor comprises a continuous band provided with tubular carrier members in the form of open-ended pockets adapted to receive packets from said packet-making devices.

4. Apparatus as claimed in claim 1 wherein said conveyor means is arranged to pass each of said packet-making devices in turn.

5. Apparatus as claimed in claim 4 wherein each of said packet-making devices includes an intermittently rotatable wheel and said packet-transferring devices are operable to transfer packets to said conveyor means in a direction substantially parallel to the axes of said wheels.

6. Apparatus as claimed in claim 5 wherein said conveyor means comprises an endless conveyor having spaced carrier members and including means for driving said conveyor intermittently such that a packet may be transferred from each of said packet-making devices to one of said carrier members of said conveyor when said conveyor is stationary.

7. Apparatus as claimed in claim 6 in which said blank feeding means comprises means for advancing a continuous web of packet material and means for cutting a succession of packet blanks from said web.

8. Apparatus as claimed in claim 1 in which said blank feeding means comprises means for advancing a continuous web of packet material and means for cutting a succession of packet blanks from said web.

9. Apparatus as claimed in claim 1 in which said blank feeding means comprises first and second blank feeding means for feeding inner and outer packet materials respectively.

10. Apparatus as claimed in claim 9 in which each of said packet making devices comprises at least one packet former, first blank receiving means for receiving an inner layer of packet material from said first blank feeding means and for feeding said inner layer to said former, second blank receiving means for receiving an outer layer of packet material from said second blank feeding means and for feeding said outer layer to said former, and folding means associated with said former to wrap aid inner layer around said former and said outer layer around said former outside said inner layer.

11. Apparatus as claimed in claim 10 in which said first and second blank feeding means each comprise means for advancing a continuous web of packet material and means for cutting a succession of packet blanks from the web.

12. Apparatus as claimed in claim 10 in which each of said packet-making devices includes an intermittently rotatable wheel and a plurality of formers carried by said wheel, said first blank receiving means being arranged to feed an inner layer of packet material to each of said formers in succession at a first angular position relative to said wheel, and said second blank receiving means being arranged to feed an outer layer of packet material to each of said formers in succession at a second angular position relative to said wheel.

13. Apparatus for making open-ended packets comprising first and second blank feeding means for feeding inner and outer packet materials respectively, each blank feeding means comprising means for advancing a continuous web of packet material and means for cutting a succession of packet blanks from the web; a plurality of packet-making devices arranged to make open-ended packets, each packet-making device including an intermittently rotatable wheel, a plurality of formers carried by said wheel, and first and second blank receiving means for receiving and feeding respectively an inner layer and an outer layer of packet material onto each former in succession; a packet transferring means associated with each packet-making device; and conveyor means arranged to pass each packet-transferring means in turn, said individual packet-transferring means being arranged at spaced locations along said conveyor means and being adapted to transfer packets from the associated packet making devices to said conveyor means.

14. Apparatus as claimed in claim 13 wherein said first and second blank feeding means each comprise means for feeding blanks along separate paths from a common source to all said packet-making devices, said blank feeding means being adapted to cause blanks to be conveyed along each of said paths in rotation.

15. Apparatus as claimed in claim 14 wherein said conveyor means comprises a continuous band provided with tubular carrier members in the form of open-ended pockets adapted to receive packets from said packet-making devices.

* * * * *